US006770613B2

(12) United States Patent
Aouad et al.

(10) Patent No.: US 6,770,613 B2
(45) **Date of Patent: *Aug. 3, 2004**

(54) PROCESS FOR MAKING DETERGENT COMPOSITIONS WITH ADDITIVES

(75) Inventors: Yousef Georges Aouad, Cincinnati, OH (US); Christopher John Lienhart, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 35 days.

This patent is subject to a terminal disclaimer.

(21) Appl. No.: 10/198,207

(22) Filed: Jul. 17, 2002

(65) Prior Publication Data

US 2003/0050213 A1 Mar. 13, 2003

Related U.S. Application Data

(60) Provisional application No. 60/307,458, filed on Jul. 24, 2001.

(51) Int. Cl.[7] ..... C11D 17/00

(52) U.S. Cl. ..... 510/407; 510/421; 510/424; 510/426; 510/505; 510/506

(58) Field of Search ..... 510/407, 421, 510/424, 426, 505, 506

(56) References Cited

U.S. PATENT DOCUMENTS

| | | | |
|---|---|---|---|
| 3,709,838 | A | 1/1973 | Mausner et al. |
| 4,615,820 | A | 10/1986 | Hepworth et al. |
| 4,929,380 | A | 5/1990 | Schulz et al. |
| 5,008,031 | A | 4/1991 | Schulz et al. |

FOREIGN PATENT DOCUMENTS

| | | |
|---|---|---|
| EP | 030096 | 6/1981 |
| EP | 565017 | 10/1993 |
| WO | WO 92/09678 | 6/1992 |
| WO | WO 98/00516 | 1/1998 |
| WO | WO 01/09273 | 2/2001 |

*Primary Examiner*—Necholus Ogden
(74) *Attorney, Agent, or Firm*—Kim W. Zerby; Steven W. Miller

(57) ABSTRACT

A process for making substantially anhydrous surfactant compositions which, at room temperature, are shear thinning non-Newtonian pastes with a yield point that allows them to be easily worked in commercial apparatus. The process employs hydrotropes, anionic surfactants and nonionic surfactants in a drying step to provide the pastes. The pastes are especially suitable for incorporation into anhydrous liquid detergent products.

9 Claims, No Drawings

PROCESS FOR MAKING DETERGENT COMPOSITIONS WITH ADDITIVES

CROSS-REFERENCE TO RELATED APPLICATION

This application claims priority from Provisional Application Ser. No. 60/307,458, filed Jul. 24, 2001.

FIELD OF THE INVENTION

The present invention relates to processes for making non-aqueous liquid laundry detergent compositions which contain an anhydrous anionic sulfated or sulfonated surfactant, a non-aqueous liquid surfactant, a hydrotrope, and optionally, but preferably, other conventional detergent ingredients, as well as processes for drying (removing water from) detergent ingredients, especially surfactants for use in detergent compositions, especially the non-aqueous liquid laundry detergent compositions of the present invention. In addition to the above, the present invention also provides a means for drying such detergent ingredients without the need to reclaim the solvent used in the process.

BACKGROUND OF THE INVENTION

Liquid laundry detergent products offer a number of advantages over dry, powdered or particulate laundry detergent products. Liquid laundry detergent products are readily measurable, speedily dissolved in wash water, non-dusting, are capable of being easily applied in concentrated solutions or dispersions to soiled areas on garments to be laundered and usually occupy less storage space than granular products. Additionally, liquid laundry detergents may have incorporated into their formulations materials which would deteriorate in the drying operations employed in the manufacture of particulate or granular laundry detergent products. Because liquid laundry detergents are usually considered to be more convenient to use than granular laundry detergents, they have found substantial favor with consumers.

Although liquid laundry detergents have a number of advantages over granular laundry detergent products, there are also disadvantages entailed in using them. In particular, laundry detergent composition components which may be compatible with each other in granular products may tend to interact or react with each other in a liquid, and especially in an aqueous liquid environment. Components such as surfactants, perfumes, brighteners and non-aqueous solvents can be especially difficult to incorporate into liquid laundry detergent products with an acceptable degree of compositional stability. Poor compositional stability may cause the detergent composition to degenerate into an unaesthetic, ineffective, heterogeneous detergent composition during storage.

One approach for enhancing the chemical compatibility and stability of liquid laundry detergent products has been to formulate substantially anhydrous non-aqueous liquid laundry detergent compositions. Generally, the chemical stability of the components of a non-aqueous liquid laundry detergent composition increases as the amount of water in the laundry detergent composition decreases. Moreover, by minimizing the amount of water in a liquid laundry detergent composition, one can maximize the surfactant activity of the composition. Non-aqueous liquid laundry detergent compositions have been disclosed in Hepworth et al., U.S. Pat. No. 4,615,820, Issued Oct. 17, 1986; Schultz et al., U.S. Pat. No. 4,929,380, Issued May 29, 1990, Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992; and Sanderson et al., EP-A-565,017, Published Oct. 13, 1993.

But, non-aqueous liquid laundry detergents come with their own set of disadvantages and problems. The desirable advantage of having excellent compositional stability may also mean that the non-aqueous liquid laundry detergent will have poor solubility and dispersion properties in the wash liquor inside an automatic clothes washer. Also non-aqueous liquids typically have awkward rheological properties, displaying a tendency known as "shear thickening", where the viscosity of the paste or liquid increases with an increasing shear rate, making the paste difficult to pump, store and transport. Moreover, non-aqueous liquid laundry detergent compositions are difficult and expensive to manufacture. A drying step requiring prolonged heating and stirring is necessary to eliminate the water. However it is not only difficult to consistently achieve the proper heating and stirring conditions in a manufacturing setting, but also such drying operations may have the effect of decomposing or evaporating individual components of the detergent composition. The resulting difficulty and expense involved with working with such fluids have greatly reduced their utilization as laundry detergent compositions.

The incorporation of surfactants into various consumer products, especially detergent products, such as granular detergent products and liquid detergent products, substantially anhydrous liquid detergent products in particular, is a common step in the manufacture of such products. However, the incorporation of such surfactants can present challenges to formulators, especially in the case of substantially anhydrous liquid products, because conventional surfactants, such as alkyl benzene sulfonate surfactants, are typically only available in the form of an aqueous paste prior to being processed into the products.

Given the foregoing, there is clearly a continuing need to provide processes for preparing non-aqueous liquid laundry detergent products that have a high degree of chemical and compositional stability, contain the essential components of a liquid laundry detergent composition, have a high surfactant activity and are readily soluble in a wash liquor. In addition, such processes should be easily replicated at multiple production sites and should produce liquid laundry detergent products that can be easily pumped, stored and transported.

The present invention fulfills the needs described above by providing processes for making soluble, preferably water-soluble, substantially anhydrous surfactant pastes and other detergent ingredients, products formed by such processes and compositions comprising such anhydrous surfactant pastes and/or other detergent ingredients.

SUMMARY OF THE INVENTION

The present invention encompasses a process for preparing a substantially anhydrous surfactant paste containing less than 5% water, comprising the steps of:

A) forming an aqueous surfactant mixture by blending, by weight of the mixture:
   (a) from about 5% to about 85% of an anionic surfactant;
   (b) from about 15% to about 95% of a liquid nonionic surfactant;
   (c) from about 1% to about 40% of a hydrotrope, said hydrotrope comprising at least two polar groups separated from each other by at least 5 carbon atoms;

wherein the aqueous surfactant mixture has a water content from 5% to about 80% by weight of the aqueous surfactant mixture;

B) drying the aqueous surfactant mixture under vacuum to form said substantially anhydrous surfactant paste having a water content of less than 5%, said paste at room temperature (18–30° C.) being in the form of a shear-thinning, non-Newtonian fluid, preferably having a yield value less than about 200 Pa, more preferably about 50 Pa–100 Pa at 30° C.; and C) optionally, adding an anhydrous organic liquid to the surfactant paste from step B to facilitate handling and transportation.

In a preferred process, the anionic surfactant is selected from the group consisting of alkyl benzene sulfonates, alkyl sulfates, alkyl ethoxy sulfates, and mixtures thereof. Preferably, the nonionic surfactant is selected from the group consisting of: alkoxylated (especially ethoxylated) alcohols; ethylene oxide (EO)-propylene oxide (PO) block polymers; polyhydroxy fatty acid amides; alkylpolysaccharides; and mixtures thereof.

Preferably, the weight ratio of hydrotrope; anionic surfactant is in the range of about 1:1 to about 1:100. Preferred hydrotropes are selected from the group consisting of 1,4 cyclohexane dimethanol, 1,6 hexanediol, 1,7 heptanediol, and mixtures thereof.

In one aspect, the organic liquid of step C is selected from the group consisting of: alkylene glycols; diethyl- and dipropylene glycol monobutyl ethers; glycol monobutyl ether; monoethylethers, monomethylethers, monopropylethers and monobutylethers of propoxy propanol; polyethylene glycols having a molecular weight of at least about 150; methyl acetate; methyl propionate; methyl octanoate; methyl dodecanoate; and mixtures thereof.

The invention also provides a non-aqueous liquid detergent composition, comprising a surfactant component which is a dried, substantially anhydrous surfactant paste prepared according to the foregoing manner, together with a non-aqueous solvent. Preferably, said surfactant paste comprises the hydrotrope, the nonionic surfactant and an anionic surfactant which is a member selected from the group consisting of alkyl benzene sulfonate surfactants, alkyl sulfate surfactants, alkyl ethoxy sulfate surfactants, and mixtures thereof. Most preferably, the non-aqueous solvent is butoxy propoxy propanol.

DETAILED DESCRIPTION OF THE INVENTION

The present invention provides an efficient process for preparing substantially anhydrous detergent pastes using commercially available feedstocks which comprise 20% to about 60% anionic surfactants and up to about 80%, more typically about 40%, water. The process herein can be conducted using otherwise conventional evaporation equipment, but preferably employs an agitated thin film evaporator, as disclosed more fully, hereinafter.

Reducing the water content of commercially available aqueous-based feedstocks comprising anionic surfactants is surprisingly difficult on a commercial scale. For example, attempting simply to evaporate the water from a commercial feedstock comprising an aqueous solution of sodium $C_{10}$–$C_{18}$ alkylbenzene sulfonate (LAS) yields an intractable mass. Admixing the LAS feedstock with an organic liquid such as butoxy propoxy propanol (BPP), followed by evaporation, results in the formation of an azeotrope, with the attendant difficulties of breaking the azeotrope to recover the BPP and remove the water. Admixing the LAS feedstock with a liquid, non-aqueous nonionic surfactant, followed by evaporation, yields a thick mass which is difficult to pump and otherwise handle, and which is difficult to dry to a water content of less than 5%, especially less than about 1%.

The present invention fulfills the needs identified above by providing a process for making a liquid laundry detergent composition, especially a non-aqueous liquid laundry detergent composition and a process for drying (removing water from) the detergent ingredients used to make the liquid laundry detergent composition. Such processes of the present invention can be performed without the need for a solvent recovery system because a non-aqueous surfactant acting as a solvent/carrier in the presence of a hydrotrope is used instead of an organic solvent. However, an organic solvent can be added to the non-aqueous liquid detergent composition after the non-aqueous detergent composition has been processed (for example, dried, as described herein).

In one aspect of the present invention, a process for making a non-aqueous liquid laundry detergent comprising 1) mixing an aqueous anionic sulfated or sulfonated surfactant, a non-aqueous liquid surfactant acting as a solvent and/or a carrier and a hydrotrope to form an aqueous surfactant mixture; and 2) drying the aqueous surfactant mixture under vacuum to form an anhydrous surfactant paste containing less than about 1%, by weight, of water, is provided. This process may be modified such that an individual ingredient can be processed, thereby producing a "dried" ingredient. For example, an aqueous anionic sulfonated surfactant can be dried via the drying step such that the "dried" anionic sulfonated surfactant final product mixture contains less than about 1% by weight of water. Such "dried" anionic sulfonated surfactant can then be incorporated into a non-aqueous liquid detergent composition. This drying step preferably occurs within an Agitated Thin Film Evaporator (ATFE).

A benefit of the present invention is that it provides a liquid laundry detergent composition comprising a non-aqueous liquid surfactant acting as a solvent and/or carrier, and a process for drying (removing water from) such aqueous liquid laundry detergent product with minimum volatiles in the condensed vapors.

In addition, the processes of the present invention produce non-aqueous liquid laundry detergent products that are readily soluble in a wash liquor.

Another preferred aspect of the present invention encompasses a process for making and/or drying surfactants or combinations of surfactants and/or other conventional detergent ingredients such as chelants, builders, buffers, rheology modifiers and the like. Such process comprises preparing a mixture of surfactants and/or other conventional detergent ingredients in an aqueous medium or a combination of aqueous and solvent media. This preparation step may be achieved by mixing these materials in their neutralized aqueous and/or powder form or by co-neutralizing them in the presence or absence of a solvent batchwise or continuously in a dominant bath neutralization loop such as a Chemithon, Ballestra or Manro unit. The drying step comprises feeding the prepared mixture into a drying device or equipment which is a batch or continuous drying equipment. An example of batch drying equipment is a combination tank, preferably agitated, which can be heated under vacuum. The tank is operated at suitable vacuum and temperature such that water is stripped from the mixture. An example of a continuous drying equipment is an ATFE, such as is commercially available from LCI Corporation.

Another preferred aspect of the present invention comprises, in an optional step, adding anhydrous organic solvent to the dried surfactant paste exiting the ATFE to manipulate its viscosity, hence facilitating its handling, storage, and transportation.

The present invention may also be practiced in a second aspect. This embodiment comprises a neutralization step in which a neutralized mixture is formed by a continuous neutralization loop. The mixture to be neutralized contains an acid form of an anionic surfactant, to which is added a base, a non-aqueous liquid surfactant, and a hydrotrope. The neutralized mixture has a water content of at least about 5% by weight of the neutralized mixture and is a non-Newtonian fluid. The molar ratio of the acid form of the anionic surfactant to the base is from about 1:1 to about 9:1.

In a subsequent step, a first portion of the neutralized mixture is removed from the continuous neutralization loop and dried under vacuum according to the present invention to form a non-aqueous surfactant paste having a water content of less than about 5%, more preferably less than 3%, and most preferably less than 1%, while a second portion of the neutralized mixture is recirculated in the continuous neutralization loop.

If so desired, other additives such as chelant, buffer, builder, and/or organic liquids may be added to the neutralization loop or added to the mixture after the neutralized mixture is removed from the neutralization loop The neutraliuzation loop and the drying step are not necessarily linked together.

The present invention offers the advantage of preparing a surfactant paste with only a trace amount of water and yet can incorporate many of the ingredients desirable for use in a laundry detergent composition such as bleach, bleach activators, builders, enzymes, whiteners and other additives. By minimizing the amount of water in the surfactant pastes or mixtures, one may maximize the activity of the surfactant paste.

All percentages, ratios and proportions herein are by weight, unless otherwise specified. All documents cited are, in relevant part, incorporated herein by reference. The citation of any document is not to be construed as an admission that the document is prior art against the present invention.

Definitions

As used herein, a "Newtonian fluid", is a fluid or paste whose viscosity, within a range of specified shear rates at a specified temperature, has a substantially constant value.

As used herein, a "non-Newtonian fluid", refers to a fluid which cannot be characterized as a "Newtonian fluid."

As used herein, "non-aqueous" or "anhydrous" are used synonymously and both describe a fluid in which the water content is less than 5%, especially less than about 1%, preferably about 0% to about 0.9%.

As used herein, the "molecular weight" of various polymers means weight average molecular weight.

Processes

The present invention describes a process for preparing non-aqueous liquid laundry detergents with additives by forming an aqueous surfactant mixture and then drying the mixture under a vacuum to form a non-aqueous anhydrous surfactant paste. The process of preparing non-aqueous liquid laundry detergent compositions with additives has many important parameters and incorporates many different ingredients and additives, as well as numerous other preferable and optional process subparts, which are described hereafter.

Forming the Aqueous Surfactant Mixture

In one aspect, the process, herein can be conducted batch-wise. For example, the selected ingredients are placed in a mixer with an impeller stirrer to form an aqueous surfactant mixture. It is preferable that each of the ingredients be added in the form of a neutralized aqueous solution which is comprised of about 20% water.

The first ingredient in this step is an aqueous surfactant. The final aqueous surfactant mixture will include, by weight, from about 5% to about 85%, more preferably from about 25% to about 75%, most preferably from about 40% to about 60% of anionic sulfated or sulfonated surfactant.

The second ingredient is a liquid nonionic surfactant used as a solvent and/or carrier. The final aqueous surfactant mixture will include, by weight, from about 5% to about 95%, more preferably from about 7% to about 85%, most preferably from about 10% to about 70% of a liquid nonionic surfactant. Suitable liquid surfactants are discussed in greater detail below.

The third ingredient in the formation step is the specified hydrotrope. The final aqueous surfactant mixture will include, by weight, from about 2% to about 40%, more preferably from about 5% to 30% by weight, of hydrotrope. Hydrotropes are discussed in greater detail below.

If used, a fourth ingredient in the formation step is comprised of optional detergent additives such as chelants, buffers, builders, enzymes, whiteners, rheology modifiers, polymers and copolymers. These are discussed in greater detail below.

The aqueous surfactant mixture in the first (mixing) step preferably contains, by weight, at least about 5%, typically about 5%–80%, more typically from about 18% to about 50%, of water. The aqueous surfactant mixture is formed by mixing together all of the ingredients (in any order) into a substantially uniform mixture, at a temperature of between about 25° C. and about 80° C., preferably at a temperature of between about 35° C. and about 70° C. and most preferably at a temperature of between about 45° C. and about 60° C. Temperature control is important because if the temperature is too low, it will be difficult to process the mixture and if the temperature is too high there may be degradation of components of the mixture.

The mixing in the surfactant mixture formation step is most preferably carried out in a standard mixer or crutcher. The speed of the mixer and the duration of the mixing step varies depending on the type of mixer and ingredients used. Mixing should be done at a speed and for a time sufficient to achieve a homogenous aqueous surfactant mixture.

Drying the Aqueous Surfactant Mixture

The aqueous surfactant mixture prepared in the foregoing manner is then pumped into a drying device where the drying step takes place. The drying step of the process is drying the aqueous surfactant mixture under vacuum to form a non-aqueous, substantially anhydrous surfactant paste, preferably containing less than about one percent, by weight, of water. This drying may be accomplished in any conventional evaporator, provided that the drying is performed under vacuum. Drying temperatures of 90° C. to 200° C. are typical. Suitable evaporators are illustrated in Perry's Chemical Engineering Handbook, 7th. Ed., 1997. McGraw-Hill, ppg 11–108 to 11–111. "Evaporator Types and Applications". A preferred evaporator is a steam jacketed agitated thin-film evaporator (ATFE).

The ATFE is operated under vacuum, preferably at 25–400 mmHg, more preferably at 75–300 mmHg, and most preferably at 100–200 mmHg. The ATFE jacket temperature is operated preferably at 100–200 deg C., more preferably at 120–180 deg C., and most preferably at 130–170 deg C.

The drying step also produces a combination of water vapor and other volatiles which are subsequently condensed without the need to reclaim and recycle the volatiles. Those skilled in the art can manipulate the operating conditions of the ATFE, i.e., temperature and pressure along with inlet feed rate and residence time in the ATFE, to affect the level of water in the dried material and the level of organic matter in the condensed steam. The level of water in the exit dried material is preferably less than 3%, more preferably less than 2%, and most preferably less than 1% by weight. The level of organic matter in the condensed steam is preferably less than 2%, more preferably less than 1.2% and most preferably less than 0.6% by weight.

An optional processing step which follows drying is the addition of an anhydrous organic solvent to the dried surfactant paste exiting the ATFE to manipulate its viscosity, thereby facilitating its handling, storage, and transportation.

The processes of the present invention can also be practiced in a second aspect, which is continuous In this aspect, a neutralized, surfactant mixture is formed by a continuous neutralization loop. Four components are continuously added to the neutralization loop: an acid form of an anionic sulfated or sulfonated surfactant; a neutralization base; a non-aqueous liquid surfactant; and the hydrotrope. A mixture of the components is formed as the components are circulated through a mixer, pump and heat exchanger. Neutralization takes place as the base reacts with the acid form of the surfactant to produce a surfactant salt. The resulting neutralized mixture has a water content of at least about 15% by weight of the neutralized mixture and is a non-Newtonian fluid.

Any neutralization base which adequately neutralizes the acid form of the surfactant is suitable. Preferred neutralization bases include the alkali metal carbonates, alkali metal hydroxides and alkali metal phosphates, e.g., sodium carbonate, sodium hydroxide, and sodium polyphosphate.

A first portion of the neutralized mixture can be recirculated in the continuous neutralization loop while a second portion is pumped from the continuous neutralization loop. If so desired, other additives such as chelant, buffer builder, and/or organic liquids may be added to and mixed with the second portion of the neutralized mixture in a static mixer, with the resulting mixture typically having a water content of from about 5% to about 50%, by weight. The resulting mixture is then further mixed in a static mixer. Depending on the needs of the formulator, additional chelant or organic liquid, for example, may again be added to the second portion of the neutralized mixture and again mixed in a static mixer or a conventional mixer such as a crutcher.

The molar ratio of the acid form of the anionic surfactant to the base is from about 1:1 to about 9:1. It is preferable that these ingredients be added in the form of an aqueous solution where appropriate. The various components which are added to the continuous neutralization loop will preferably have the following amounts of water:

| | |
|---|---|
| acid form of anionic sulfated or sulfonated surfactant | Less than 2.0% |
| neutralization base | from about 30% to about 90% |
| non-aqueous liquid surfactant | Less than 2% |
| hydrotrope | Less than 1% |

The second portion of the neutralized mixture is then dried under vacuum to form a substantially anhydrous surfactant paste having a water content of less than 5% most preferably less than 1%. The drying operation is as described above and may use the same equipment and process variables.

The processes described above offer the advantage of preparing a surfactant paste with only a trace amount of water yet incorporating many of the ingredients desirable for use in a laundry detergent composition such as builders, whiteners and other additives. By minimizing the amount of water in the surfactant pastes, one may maximize the activity of the surfactant paste. Furthermore, the present invention allows the manufacture of an anhydrous high-active surfactant paste which can be further mixed with an anhydrous organic solvent and/or carrier to manipulate its rheology, thus making it easier for handling, storage and transportation.

The processes described herein may also be combined with other known detergent-manufacturing process steps commonly used in the detergent industry for the manufacture of liquid or solid detergents in any form (e.g. granular, tablet etc.).

Non-aqueous Liquid Detergent Products

The anhydrous surfactant paste of the present invention may be incorporated into non-aqueous (anhydrous) liquid detergent products along with other detergent ingredients. Such non-aqueous liquid detergent products typically contain a liquid phase and a solid phase. The liquid phase typically comprises a nonionic surfactant and a non-aqueous, low-polarity organic solvent. The solid phase typically contains one or more particulate materials, such as bleaching agents.

The nonaqueous liquid detergent compositions herein can be prepared by combining the essential and optional components thereof in any convenient order and by mixing, e.g., agitating, the resulting component combination to form the phase stable compositions herein. In a preferred process for preparing such compositions, essential and certain preferred optional components will be combined in a particular order. Such a process is described in detail in U.S. Pat. No. 5,872,092 to Kong-Chan et al.

In such a preferred preparation process, a liquid matrix is formed containing at least a major proportion, and preferably substantially all, of the liquid components, e.g., an alcohol ethoxylate nonionic surfactant and the nonaqueous, low-polarity organic solvent, with the liquid components being thoroughly admixed by imparting shear agitation to this liquid combination. For example, rapid stirring with a mechanical stirrer may usefully be employed.

While shear agitation is maintained, essentially all of the alkyl sulfate or alkyl benzene sulfonate anionic surfactant, e.g., sodium lauryl sulfate or $C_{11}$–$C_{13}$ sodium alkyl benzene sulfonate, can be added in the form of particles ranging in size from about 0.2 to 1,000 microns. After addition of the surfactant the substantially anhydrous paste produced herein, or as particles, particles of an alkalinity source, e.g., sodium carbonate, can be added while continuing to maintain this admixture of composition components under shear agitation. Other solid form optional ingredients can be added to the composition at this point. Agitation of the mixture is continued, and if necessary, can be increased at this point to form a uniform dispersion of insoluble solid phase particulates within the liquid phase.

After some or all of the optional solid materials have been added to this agitated mixture, the particulate materials can be added to the composition, again while the mixture is maintained under shear agitation.

As a variation of the non-aqueous liquid composition preparation procedure hereinbefore described, one or more of the solid components may be added to the agitated mixture as a slurry of particles premixed with a minor portion of one or more of the liquid components.

Thus, a premix of a small fraction of the nonionic surfactant and/or nonaqueous, low-polarity solvent with particles of the alkyl sulfate surfactant and/or the particles of the alkalinity source and/or particles of a bleach activator may be separately formed and added as a slurry to the agitated mixture of composition components.

The processes described herein may also be combined with other known detergent-manufacturing process steps commonly used in the detergent industry for the manufacture of liquid or solid detergents in any from (e.g. granular, tablet etc.).

Preferred Detergent Ingredients

Anionic Surfactants

Suitable anionic sulfated or sulfonated surfactants include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Further anionic surfactants herein are the sodium alkyl glyceryl ether sulfonates, especially those ethers of higher alcohols derived from tallow and coconut oil; sodium coconut oil fatty acid monoglyceride sulfonates.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of-olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization can be performed as part of the fine dispersion mixing step.

Particularly preferred surfactants herein include linear alkylbenzene sulfonates containing from about 11 to 14 carbon atoms in the alkyl group; tallow alkyl sulfates; coconutalkyl glyceryl ether sulfonates; olefin or paraffin sulfonates containing from about 14 to 16 carbon atoms; alkyldimethylamine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms and mixtures thereof.

Specific preferred surfactants for use herein include: triethanolammonium $C_{11}$–$C_{13}$ alkylbenzene sulfonate; sodium coconut alkyl glyceryl ether sulfonate; sodium coconut alkyl glyceryl ether sulfonate; the condensation product of a $C_{12}$–$C_{13}$ fatty alcohol with about 3 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; and mixtures thereof.

Non-aqueous Surfactants

These surfactants comprise various non-ionics. Suitable types of non-aqueous surfactant liquids which can be used herein include, but are not limited to, alkoxylated alcohols, ethylene oxide (EO)-propylene oxide (PO) block polymers, polyhydroxy fatty acid amides, alkylpolysaccharides, and the like.

Alcohol alkoxylates are materials which correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid phase will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful in or as the non-aqueous liquid phase of the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

If an alcohol alkoxylate nonionic surfactant is utilized as part of the non-aqueous liquid phase in the compositions and processes herein, it will preferably be present to the extent of from about 1% to 60% of the liquid phase. More preferably, the alcohol alkoxylate component will comprise about 5% to 40% of the liquid phase. Most preferably, an alcohol alkoxylate component will comprise from about 5% to 35%, of the liquid phase. Utilization of alcohol alkoxylate in these concentrations in the liquid phase corresponds to an alcohol alkoxylate concentration in the finished composition of from about 1% to 60% by weight, more preferably from about 2% to 4% by weight, and most preferably from about 5% to 25% by weight, of the composition. (Other nonionics are used herein at similar levels.)

Another type of non-aqueous surfactant liquid which may be utilized in this invention are the ethylene oxide (EO)-propylene oxide (PO) block polymers. Materials of this type are well known nonioic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents, 7th Ed.*; Longman Scientific and Technical (1987) at pp. 34–36 and pp. 189–191 and in U.S. Pat. Nos. 2,674,619 and 2,677,700. These Pluronic type nonionic surfactants are also believed to function as effective suspending agents for the particulate material which is dispersed in the liquid phase of the detergent compositions herein.

Another possible type of non-aqueous surfactant liquid useful in the compositions herein comprises polyhydroxy fatty acid amide surfactants. Such materials include the $C_{12}$–$C_{18}$ N-methyl glucamides. Examples are N-methyl N-1-deoxyglucityl cocoamide and N-methyl N-1-deoxyglucityl oleamide. Processes for making polyhydroxy fatty acid, amides are known and can be found, for example, in Wilson, U.S. Pat. No. 2,965,576 and Schwartz, U.S. Pat. No. 2,703,798. The materials themselves and their preparation are also described in greater detail in Honsa, U.S. Pat. No. 5,174,937, Issued Dec. 26, 1992.

Hydrotropes

The hydrotropes described in this section are an essential component employed in the present invention. It has been discovered that the addition of a hydrotrope in which two polar groups are separated from each other by at least 5, preferably 6, aliphatic carbon atoms to the aqueous surfactant prior to drying significantly improves the drying rates in the evaporator and significantly reduces the amount of organic material in the condensed stream. It has also been discovered that the addition of the hydrotrope alters the rheology of the dried surfactant paste by reducing the yield point and the viscosity. Examples of suitable polar groups for inclusion in the hydrotrope include are hydroxyl and carboxyl ions. Particularly preferred hydrotropes are selected from the group consisting of:

1,4 Cyclo Hexane Di Methanol (CHDM): $HOCH_2C_6H_{10}CH_2OH$;

1,6 Hexanediol: $HO(CH_2)_6OH$: and 1,7 Heptanediol $HO(CH_2)_7OH$; and mixtures thereof, 1,4 Cyclo Hexane Di Methanol may be present in either its cis configuration, its trans configuration or a mixture of both configurations.

Optional Detergent Ingredients

Non-surfactant Non-aqueous Organic Solvents

The liquid phase of the finished, fully-formulated detergent compositions herein may also comprise one or more non-surfactant, non-aqueous organic solvents. The detergent compositions of the present invention will contain from about 15% to about 95%, more preferably from about 30% to about 70%, most preferably from about 40% to about 60% of an organic solvent. Such non-surfactant non-aqueous liquids are preferably those of low polarity. For purposes of this invention, "low-polarity" liquids are those which have little, if any, tendency to dissolve the preferred types of particulate material used in the compositions herein, i.e., the peroxygen bleaching agents, sodium perborate or sodium percarboniate. Thus, relatively polar solvents such as ethanol are preferably not utilized. Suitable types of low-polarity solvents useful in the non-aqueous liquid detergent compositions herein do include alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,3-butylene glycol and 1,4-butylene glycol. Hexylene glycol is the most preferred.

Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropylene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of this type have been commercially marketed under the tradenames Dowanol, Carbitol, and Cellosolve.

Another preferred type of non-aqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components, e.g., bleach and/or activators, used in the liquid detergent compositions herein. Such a solvent component is preferably utilized in an amount of from about 1% to 70% by weight of the liquid phase. More preferably, a non-aqueous, low-polarity, non-surfactant solvent will comprise from about 10% to 60% by weight of a structured liquid phase, most preferably from about 20% to 50% by weight, of a structured liquid phase of the composition. Utilization of non-surfactant solvent in these concentrations in the liquid phase corresponds to a non-surfactant solvent concentration in the total composition of from about 10% to 30%, by weight, more preferably from about 5% to 40% by weight, and most preferably from about 10% to 30% by weight, of the composition.

Other Optional Conventional Detergent Ingredients

In addition to the preferred and/or desirable detergent ingredients described above, the present surfactant mixture and/or pastes of the present invention and/or detergent compositions formed with such surfactant pastes can, and preferably will, contain various other optional detergent additives. Such optional detergent additives are typically added to the surfactant mixture in the form of dilute aqueous solutions prior to drying.

Chelants

The surfactant mixtures and/or pastes of the present invention herein may also contain a chelant which serves to chelate metal ions, e.g., iron and/or manganese. Preferably the detergent products made with the anhydrous surfactant paste of the present invention will contain from about 0.1% to about 10%, more preferably from about 0.5% to about 5%, most preferably from about 1% to about 3% of a chelant. Such chelants thus serve to form complexes with metal impurities in the composition which would otherwise tend to deactivate composition components such as peroxygen bleaching agents. Useful chelating agents can include amino carboxylates, phosphonates, amino phosphonates, polyfunctionally-substituted aromatic chelating agents and mixtures thereof. Other suitable chelants are disclosed in U.S. Pat. Nos. 5,712,242, issued Jan. 27, 1998, to Aouad et al.

Amino carboxylates useful as optional chelating agents include ethylenediaminetetraacetates, N-hydroxyethylethylenediaminetriacetates, nitrilotriacetates, ethylenediamine tetrapropionates, triethylenetetraaminehexacetates, diethylenetriaminepentaacetates, ethylenediaminedisuccinates and ethanol diglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethlylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

Organic Detergent Builders

Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the SOKALANT™ which have molecular weight ranging from about 5,000 to 100,000. (Molecular weights of polymers used herein can be measured by mass spectrometry.)

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Organic detergent builders can generally comprise from about 2% to 20% by weight of the compositions herein. More preferably, such builder material can comprise from about 4% to 10% by weight of the composition.

Inorganic Detergent Builders

Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986. Also, crystalline layered silicates, such as those discussed in this '509 U.S. patent, are also suitable for use in the detergent compositions herein. If utilized, optional inorganic detergent builders can comprise from about 2% to 40% by weight of the compositions herein Polymers and/or Co-polymers The polymers and copolymers useful in the present invention may be chosen from a wide range of organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates, polyaspartates, polyvinylpyrrolidones and various copolymers, such as those of maleic and acrylic acids. Molecular weights for such polymers vary widely, but most are within the range of 2,000 to 100,000. Usage levels are typically 0.1%–10%.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Most preferred for use in the present invention are copolymers of maleic and acrylic acid having a molecular weight of from 2000 to 100,000, carboxymethyl cellulose and mixtures thereof. The concentration of the aqueous solutions of the polymer or copolymer is not critical in the present invention. However, it is convenient to use solutions which are readily available commercially.

Another suitable class of polymers which is especially useful in processes of the present invention where an anhydrous agglomerate is desired is anhydrous liquid polymers, preferably cationic anhydrous liquid polymers. Solutions having a concentration of from 5% to $_{60}$% of the polymer or copolymer are suitable.

Optional Brighteners, Suds Suppressors, and/or Dyes

Conventional brighteners, suds suppressors, bleach, bleach activators, bleach catalysts, dyes and/or perfume materials may be incorporated into the surfactant mixtures and/or pastes and/or detergent products of the present invention. Such ingredients must be compatible and non-reactive with the other composition components in a non-aqueous environment. If present, such ingredients will typically comprise from about 0.0001% to 8% by weight of the compositions herein. Ethoxylated quat clay softeners can also be used.

The following examples are illustrative of the present invention, but are not meant to limit or otherwise define its scope. All parts, percentages and ratios used herein are expressed as percent weight of the composition unless otherwise specified. In all examples, Karl Fischer analysis is used to determine amount of residual water A rotational rheometer, Cari-med, supplied by TA Instruments, Delaware, USA is used to measure rheology. Gas Chromatography is used to determine amount of organic content in condensed vapors.

Example 1 is a comparative example which shows that the absence of the hydrotrope results in a difficult-to-process material with high organic content in the condensed stream. Example 2 shows that the addition of a hydrotrope significantly improves processing while reducing organic content in the condensed stream to levels where organic recovery may not be needed.

EXAMPLE 1

This process is comprised of two key steps. In the first step raw materials in the form of aqueous solutions are combined at a typical batch size of 1000 lb. In the second step, the water is removed from the aqueous feed stock. In the mixing step, at room temperature, a 37% active aqueous solution of the sodium salt of [S,S]-ethylenediamino-N-N'-disuccinic acid (NaEDDS) chelant is added to a 50% active aqueous solution of the sodium salt of linear alkyl benzene sulfonate (LAS). The NaEDDS chelant contains a minimum of 99% S,S isomer of the total NaEDDS isomers and a minimum of 95% S,S isomer of the total amino acid species. The solution is mixed until it appears homogeneous. Next, an ethoxylated alcohol, Neodol 23-25 at a minimum purity of 99% is added to the other components at room temperature, and all components are mixed until the mixture appears homogeneous. The formula details for the resulting aqueous solution are summarized below.

TABLE 1

Composition of Aqueous Solutions

| Component | LAS Solution | NaEDDS Solution | Neodol 23-25 |
|---|---|---|---|
| Activity of Aqueous Solution (%) | 50 | 37 | 100 |
| Amount in Aqueous Solution Added (lb) | 681 | 91.9 | 227 |
| Amount on Dry Basis (%) | 56.6 | 5.66 | 37.74 |

The water is removed from the aqueous mixture in a 5.4 $ft^2$ steam-jacketed agitated thin film evaporator. The aqueous mixture containing about 39%, water is pumped at room temperature at a rate of 25 kg/hr to the evaporator, operating at a temperature of 160° C. and a pressure of 168 mm Hg. The product exits the evaporator at a temperature of 124.5° C. with a moisture content of 0.71%. The material is difficult to process and the product exiting the ATFE is difficult to handle. Its rheology is characterized as a shear thinning non-Newtonian fluid with a yield point of about 200 Pa (Pascals). The amount of organic matter in the condensed stream is about 7%.

EXAMPLE 2

This process is comprised of two key steps. In the first (mixing) step, raw materials in the form of aqueous solutions are combined at a typical batch size of 1000 lb. In the second step, the water is removed from the aqueous feed stock. In the mixing step, at room temperature, a 37% active aqueous solution of the sodium salt of [S,S]-ethylenediamino-N-N'-disuccinic acid (NaEDDS) chelant is added to a 50% active aqueous solution of the sodium salt of linear alkyl benzene sulfonate (LAS). The NaEDDS chelant contains a minimum of 99% S,S isomer of the total NaEDDS isomers and a minimum of 95% S,S isomer of the total amino acid species. The solution is mixed until it appears homogeneous. Next, CHDM, at a minimum purity of 99% is added and the resulting solution is mixed until it appears homogeneous. Next, an ethoxylated alcohol, Neodol 23-25 at a minimum purity of 99% is added to the other components at room temperature, and all components are mixed until the mixture appears homogeneous. The formula details for the resulting aqueous solution are summarized below.

TABLE 2

Composition of Aqueous Solutions

| Component | LAS Solution | NaEDDS Solution | CHDM | Neodol 23-25 |
|---|---|---|---|---|
| Activity of Aqueous Solution (%) | 50 | 37 | 100 | 100 |
| Amount in Aqueous Solution Added (lb) | 586.5 | 67.9 | 240.9 | 104.7 |
| Amount on Dry Basis (%) | 44.16 | 3.79 | 36.28 | 15.77 |

The water is removed from the aqueous mixture in a 5.4 $ft^2$ steam-jacketed agitated thin film evaporator. The aqueous solution containing about 32% water is pumped at room temperature at a rate of 100 kg/hr to the evaporator, operating at a temperature of 160° C. and a pressure of 168 mm Hg. The product exits the evaporator at a temperature of 100° C. with a moisture content of 0.45%. The product is then cooled in a plate and frame heat exchanger to 40° C. The amount of organic matter in the condensed stream is less than 0.5%. The product exiting the ATFE is characterized as a shear thinning non-Newtonian fluid with a yield point of about 10 Pa.

EXAMPLES 3–5

In the following Examples 3–5, $C_{11}$–$C_{13}$ alkylbenzene is sulfated to make linear alkyl benzene sulfonate, acid form ("HLAS") having a completeness and acid value of 97 and 172.14, respectively. The acid is neutralized in a continuous neutralization system such as a neutralization loop available from the Chemithon Corporation, Seattle, Wash., USA in the presence of a chelant and an anhydrous liquid surfactant acting as a solvent/carrier. The mixture exiting the loop is then dried in an agitated thin film evaporator ("ATFE") such as the one supplied by LCI Corporation, Charlotte, N.C., USA.

EXAMPLE 3

The HLAS is neutralized with 50% solution of NaOH while co-adding a 37% solution of the sodium salt of [S,S]-ethylenediamino-N-N'-disuccinic acid ("NaEDDS"), CHDM, and Neodol 23-25. The combined flow rate of all components into the neutralization loop at room temperature is 1.238 kg/min. The temperature of neutralization is about 73° C. while the temperature of the mixture exiting the loop is about 71° C.

TABLE 3

Composition of Aqueous Solutions

| Component | LAS Solution | NaEDDS Solution | CHDM | Neodol 23-25 |
|---|---|---|---|---|
| Activity of Aqueous Solution (%) | 50 | 37 | 100 | 100 |
| Amount in Aqueous Solution Added (lb) | 678.9 | 78.6 | 121.2 | 121.2 |
| Amount on Dry Basis (%) | 44.16 | 3.79 | 36.28 | 15.77 |

The mixture containing about 15% water is then fed at room temperature continuously at a rate of 107 kg/hr into a 5.4 $ft^2$ steam jacketed ATFE operating at 160° C. and 105 mmHg. The resulting dry material contains 0.41% water. The amount of organic matter in the evaporated water is less than 2%. The yield point is less than 200 Pa.

EXAMPLE 4

The HLAS is neutralized with 50% solution of NaOH while co-adding a 37% solution of the sodium salt of [S,S]-ethylenediamino-N-N'-disuccinic acid ("NaEDDS"), CHDM, and Neodol 23-25. The combined flow rate of all components into the neutralization loop at room temperature is 1.504 kg/min. The temperature of neutralization is 53.3° C. while the temperature of the mixture exiting the loop is 50.5° C.

TABLE 4

Composition of Aqueous Solutions

| Component | LAS Solution | NaEDDS Solution | Neodol 23-25 | CHDM |
|---|---|---|---|---|
| Activity of Aqueous Solution (%) | 50 | 37 | 100 | 100 |
| Amount in Aqueous Solution Added (lb) | 586.5 | 67.9 | 240.9 | 104.7 |
| Amount on Dry Basis (%) | 44.16 | 3.79 | 36.28 | 15.77 |

The mixture containing about 14% water is then fed at room temperature continuously at a rate of 212 kg/hr into a 5.4 $ft^2$ steam jacketed ATFE operating at 160° C. and 100 mmHg. The resulting dry material contains 0.37% water. The amount of organic matter in the evaporated water is less than 1.5%. The yield point is less than 200 Pa.

EXAMPLE 5

Cooled dried material from any of Examples 2,3, or 4 is further mixed batchwise or continuously inline via a static mixer with an organic solvent n-butoxy propoxy propanol ("n-BPP") produced by the Dow Chemical of Midland, Mich. BPP is used as a co-solvent and/or co-carrier to eliminate the yield point and lower the viscosity. This improves the handling and transportation of the dried material.

EXAMPLE 6

Paste made in Example 2 can be added as a component so as to achieve the following overall composition of a non-aqueous liquid detergent prepared in accordance with the invention, which uses BPP as a carrier liquid.

| Component | Wt % |
|---|---|
| Na LAS | 15.33 |
| Nonionic Surfactant[1] | 20.4 |
| n-BPP | 17.55 |
| Hydrotrope[2] | 4.74 |
| NaCitrate dihydrate | 3.66 |
| Phosphonate[3] | 2.85 |
| $Na_3EDDS$ | 1.15 |
| Ethoxylated Quaternized amine clay material | 1.23 |
| Na Perborate | 11.38 |
| Bleach Activator | 5.69 |
| NaCarbonate | 9.49 |
| Protease | 0.81 |
| Amylase | 0.76 |

-continued

| Component | Wt % |
|---|---|
| Carezyme | 0.03 |
| Q-Cell 300 microspheres | 0.95 |
| Silicone antifoam | 1.02 |
| fatty acid[4] | 0.47 |
| $TiO_2$ | 0.47 |
| Brightener | 0.19 |
| PEG 8000 | 0.38 |
| Sodium Sulfate | 0.43 |
| $H_2O$ | 0.20 |
| Miscellaneous up to | 0.82 |
| 100% | |

-continued

| Component | Wt % |
|---|---|
| TOTAL | 100% |

[1]:Neodol ™ 23-5.
[2]:1.4 Cyclo Hexane Di Methanol.
[3]:diethylenetriaminepenta (methylenephosphonic acid).
[4]:sodium salt of hydrogenated C14-C18 fatty acid.

As can be seen from the foregoing, the present invention provides several advantages over previous processes for producing substantially anhydrous surfactant mixtures:

1.) The organic material in the condensed phase due to drying is substantially reduced;

2.) An organic solvent recovery step is substantially reduced or eliminated due to elimination of the aseotrope;

3.) The process allows combinations of anionic/nonionic sulfactants to be prepared without need for additional organic solvents;

4.) The materials used in the process may be part of the finished, non-aqueous liquid detergent product.

Having described the present invention in detail with reference to preferred embodiments and Examples, it will be clear to those skilled in the art that various changes and modifications may be made without departing from the scope of the invention, and the invention is not to be considered limited to what is described in the specification.

What is claimed is:

1. A process for preparing a non-Newtonian substantially anhydrous surfactant paste containing less than 5% water, comprising the steps of:

A) forming an aqueous surfactant mixture by blending, by weight of the mixture:

(a) from about 5% to about 85% of an anionic surfactant;

(b) from about 5% to about 95% of a liquid nonionic surfactant;

(c) from about 1% to about 40% of a hydrotrope, said hydrotrope comprising at least two polar groups separated from each other by at least 5 carbon atoms;

wherein the aqueous surfactant mixture has a water content from 5% to about 80% by weight of the aqueous surfactant mixture;

B) drying the aqueous surfactant mixture under vacuum to form said substantially anhydrous surfactant paste having a water content of less than 5%, said paste being in the form of a shear-thinning non-Newtonian fluid having a yield value less than about 200 Pa at 30° C.; and C) optionally, adding an anhydrous organic liquid to the surfactant paste from step B to facilitate handling and transportation.

2. A process according to claim 1, wherein the anionic surfactant is selected from the group consisting of alkyl benzene sulfonates, alkyl sulfates, alkyl ethoxy sulfates, and mixtures thereof.

3. A process according to claim 1, wherein the nonionic surfactant is selected from the group consisting of: alkoxylated alcohols, ethylene oxide (EO)-propylene oxide (PO) block polymers, polyhydroxy fatty acid amides, alkylpolysaccharides, and mixtures thereof.

4. A procsss according to claim 1, wherein the hydrotrope is selected from the group consisting of 1,4 cyclohexane dimethanol, 1,6 hexanediol, 1,7 heptanediol, and mixtures thereof.

5. A process according to claim 1, wherein the hydrotrope is 1,4 cyclohexane dimethanol.

6. A process according to claim 1, wherein the organic liquid of step C is selected from the group consisting of: alkylene glycols; diethyl- and dipropylene glycol monobutyl ethers; glycol monobutyl ether; monoethylethers; monomethylethers, monopropylethers and monobutylethers of propoxy propanol; polyethylene glycols having a molecular weight of at least about 150; methyl acetate; methyl propionate; methyl octanoate; methyl dodecanoate; and mixtures thereof.

7. A non-aqueous liquid detergent composition, comprising:

a) a substantially anhydrous non-Newtonian surfactant paste prepared according to claim 1; and b) a non-aqueous solvent.

8. A composition according to claim 7, wherein said surfactant paste comprises a member selected from the group consisting of alkyl benzene sulfonate surfactant, alkyl ethoxy sulfate surfactant, alkyl sulfate surfactant, and mixtures thereof.

9. A composition according to claim 8, wherein said non-aqueous solvent is butoxy propoxy propanol.

* * * * *